United States Patent [19]

Cobbs et al.

[11] 3,958,650

[45] May 25, 1976

[54] DRILLING SYSTEM USING WEIGHT OF MUD

[75] Inventors: James H. Cobbs, Tulsa, Okla.; Roger J. Morrell, Bloomington, Minn.

[73] Assignee: The United States of America as represented by the Secretary of the Interior, Washington, D.C.

[22] Filed: May 28, 1975

[21] Appl. No.: 581,408

[52] U.S. Cl. ..... 175/205; 175/212

[51] Int. Cl.[2] ..... C09K 7/00; E21B 21/00

[58] Field of Search ..... 175/212, 213, 324, 323, 175/205, 69, 71

[56] References Cited

UNITED STATES PATENTS

| | | | |
|---|---|---|---|
| 1,428,788 | 9/1922 | Larsen | 175/213 |
| 2,329,330 | 9/1943 | Brailey | 175/213 |
| 2,914,306 | 11/1959 | Failing | 175/212 |
| 3,151,690 | 10/1964 | Grable | 175/212 |
| 3,420,321 | 1/1969 | Botto | 175/213 |
| 3,431,989 | 3/1969 | Waterman | 175/213 |
| 3,841,421 | 10/1974 | Matsushita | 175/212 |

*Primary Examiner*—James A. Leppink

*Attorney, Agent, or Firm*—Gersten Sadowsky; Donald R. Fraser

[57] ABSTRACT

A drill system for drilling very large holes in the earth, of diameters up to from 10 to 20 feet, by means of a rotary bit carrying a plurality of cutters, wherein the bit assembly is pressed against the bottom of the hole, so that the unit pressure against each of the cutters will be adequate for their optimum performance. The force holding the bit in contact with the bottom of the hole is created by the weight of the drilling liquid on top of the bit. A fluid seal is maintained between the outer edge of the bit and the wall of the bore hole. Liquid flows down the annulus around the drill pipe and through a plurality of orifices in the bit, terminating at the bit cutters. Rock cuttings are washed radially inwardly to a central drill pipe, which supports the bit, and through which torque is applied to the bit. The pressure drop in the orifices serves to create a differential pressure above and below the bit. The differential pressure times the exposed surface area of the bit provides the hold down force. Cuttings are lifted out of the central drill pipe by means of a smaller diameter pipe lowered inside of the drill pipe, through which compressed air is applied.

8 Claims, 7 Drawing Figures

DRILLING SYSTEM USING WEIGHT OF MUD

BACKGROUND OF THE INVENTION

This invention lies in the field of rock drilling. More particularly, it is concerned with rock drilling machinery for drilling large diameter holes, of the order of up to 10 to 20 feet in diameter. Still more particularly, it concerns a rock drilling system in which the hold down force between the bit and its cutters, and the cutting face at the bottom of the hole, is created by the weight of drilling liquid pressing on the top of the bit.

In the prior art, and particularly, in the drilling of relatively small diameter holes, of the order of 10 to 20 inches, the weight on the bit required for proper cutting action of the cutters is created by dead weight, in the form of drill collars, which are attached to the bit and are supported by the drill pipe. If increased weight on the bit is required more drill collars are provided, etc.

However, in the drilling of very large diameter holes, in order to get the required force of some 40 thousand pounds per cutter, where there are a great number of cutters, because of the large cross sectional area of the bore hole, the amount of weight required might reach up into the millions of pounds, and would be impractical to supply in the conventional manner.

SUMMARY OF THE INVENTION

It is a primary object of this invention to provide a large diameter rock bit drilling apparatus in which the hold down force of the cutters against the rock face is created by the weight of the drilling liquid resting on the top of the bit.

It is a further object of this invention to provide a large diameter rock drilling apparatus in which the drilling liquid is reverse circulated, and the driving force for circulation of the drilling liquid is by air lift, by means of a compressed air supply pipe inserted into the drill pipe to a selected depth below the surface of the ground.

These and other objects are realized and the limitations of the prior art are overcome in this invention by using a large diameter bit assembly made of metal, as by casting or welding, which is hollow, and shaped to the contour of the bottom of the hole to be desired, and is supported by a relatively large diameter of the drill bit and the wall of the bore hole there is a liquid seal. Drilling liquid enters the drill bit by means of a plurality of orifices circumferentially located, and out through the bottom of the drill bit, at each of the locations of a plurality of cutters. Thus, the liquid will flow from the cutters radially inward along the bottom of the hole, to the center of the hole, and up through the drill pipe. The circulation of liquid in the reverse manner is provided by means of compressed air inserted into the drill pipe at a desired depth below the surface, by means of an air pipe within the drill pipe.

Any suitable rock cutters can be provided, mounted at selected radii on the bottom surface of the drill bit, so as to cut a complete surface on the bottom of the hole.

An annular seal between the outer edge of the drill bit and the wall of the bore hole is provided so that a regulated flow of drilling liquid can be maintained through the series of orifices, so that there will be a differential pressure in the liquid above and below the bit of a desired amount which controls the downward force applied to the bit, and to the contact of the cutters with the surface of the rock. In order to maintain this differential pressure, the flow must be controlled to a desired value sufficient for the lifting of the cuttings off the bottom of the hole.

While any type of annular seal can be used the preferred type involves a circumferential ledge or flange to the drill bit, and a plurality of short petals, which are bolted to this flange and are flexible enough so that they can overlap each other and can bend upward or downward so as to seal the opening while the bit is moving downward or upward in the bore hole.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
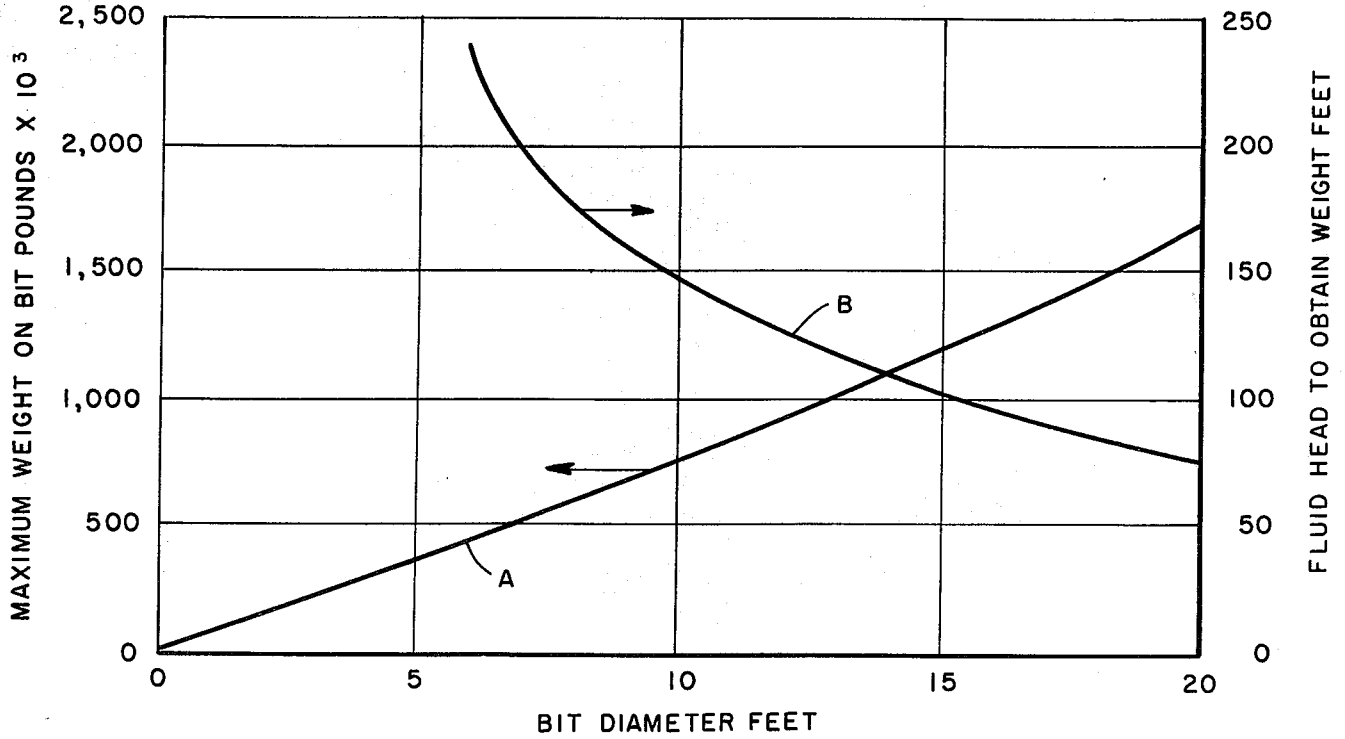
FIG. 1 illustrates by chart the magnitudes of the total force required on the bit as a function of bit diameter, and the fluid head required for adequate circulation as a function of the bit diameter.

Referring now to the drawings and in particular, to FIG. 1, it is seen from curve A that because of the great size of the bits, such as might be required for drilling working shafts in mines, for example, that when the diameter gets up in the region of 15 to 20 feet, the maximum weight on the bit in pounds might be of the order 1 to several million pounds. Whereas, in conventional oil well drilling it is simple and convenient to provide dead weight on the drill column, there is no practical way to provide these large forces required except by liquid head. Curve B shows the liquid head that might be required to create this force on the bit.

Figure 2:
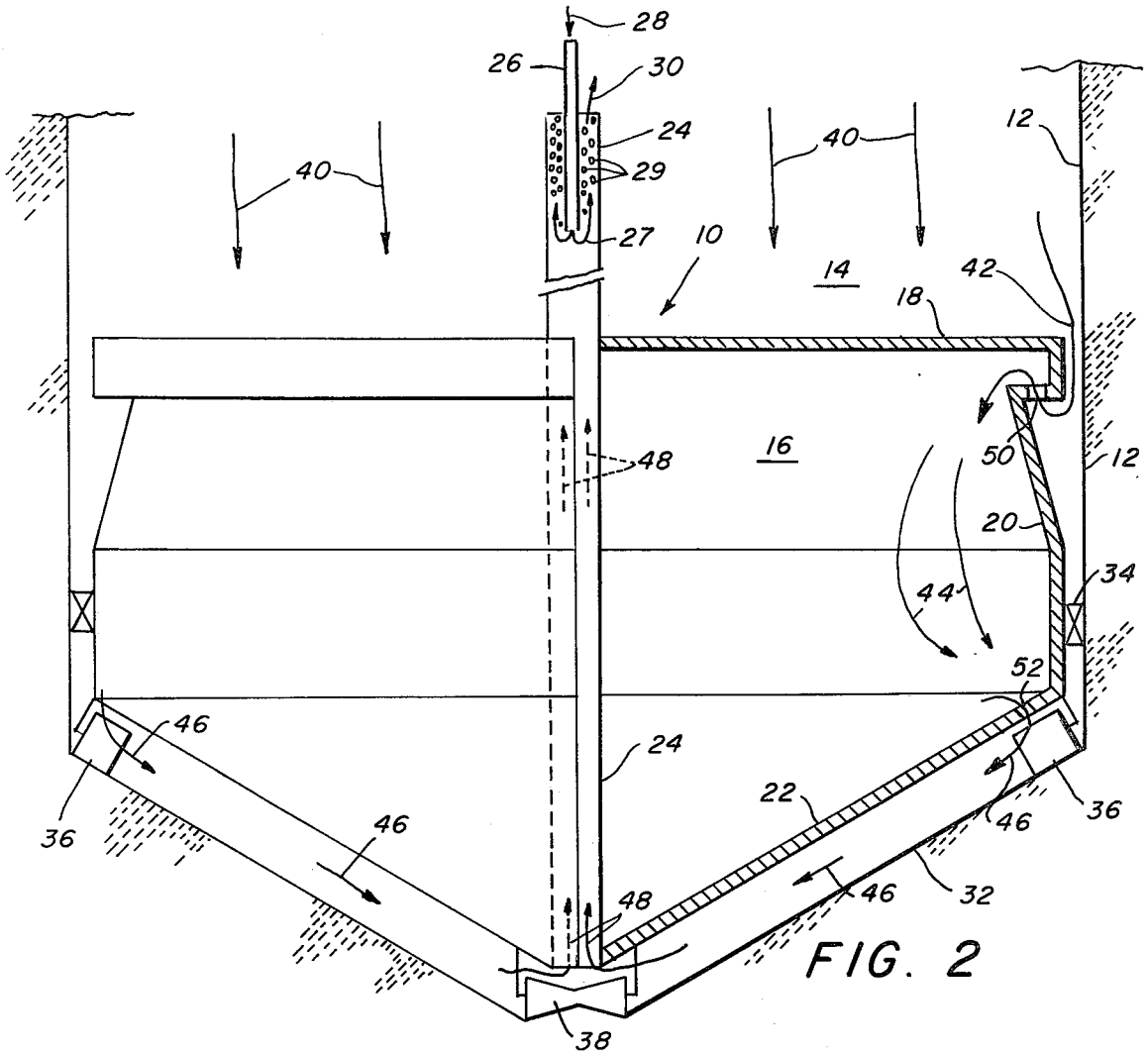
FIG. 2 illustrates, in cross section, one embodiment of this invention.

Referring now to FIG. 2 there is shown in cross section one embodiment of this invention. The drill bit structure is indicated generally by the numeral 10. It is positioned in the bottom of a drill hole 12 of desired diameter, which may be in the range of up to 10 to 20 feet.

The drill bit structure is a fabricated structure having a circular top 18, a more or less circular cylindrical wall 20 and a flat or conical bottom surface 22, which is designed to provide the desired angle of the floor of the drill hole. There are a plurality of cutting bits 36, 38 arranged on the bottom surface 22 of the drill bit. These are shown in schematic fashion in the form of a central cutter 38 and a plurality of other cutters 36, of which only two are shown at the extreme lateral positions. It is obvious that many more cutters 36 must be provided so that there will be at each radius of the hole a cutter to remove the material and therefore to provide a relatively smooth conical surface 32 to the bottom of the drill hole.

The drilling liquids, or mud, is entered into the bore hole in the annulus 14 between the drill pipe 24 and the wall 12 of the bore hole. The movement is downward as indicated by arrows 40. There are a plurality of openings 50 circumferentially arranged around the bit, so that drilling liquid can move in accordance with arrow 42 down in the annulus between the drill bit and the wall, up through the orifices 50, and into the interior of the drill bit. The liquid then proceeds in accordance with arrows 44 to a second plurality of orifices 52. These are arranged to be adjacent each of the cutters 36, so that the movement of liquid will be past the cutter, so as to sweep the rock chips and cuttings radially inwardly along the floor 32 in accordance with arrows 46. The liquid is then drawn upwardly in accordance with arrows 48 through the drill pipe 24 to the surface. The drill pipe 24 might be in the range of 10 to 14 inches in diameter which would be sufficiently strong to support, and to apply the required torque to the drill bit.

Up towards the surface, at a selected depth below the surface, a smaller diameter pipe 26 of the order of several inches in diameter, is inserted into the drill pipe and compressed air is applied in accordance with the arrow 28, which air passes down through the pipe 26 and out of the bottom in accordance with arrows 27. The air bubbles 29 create a reduced density of liquid in the pipe compared to the liquid in the annulus and so there is a circulation, a lifting of liquid in the drill pipe, and circulation of liquid down the annulus through the orifices 50 and 52 and up the drill pipe.

By positioning the compressed air pipe 26 at any desired depth there can be an increased or decreased circulation of liquid. The deeper the air pipe is inserted, the greater the differential pressure between the annulus and the drill pipe, and therefore greater the rate of flow of liquid.

One essential feature of this device is that the annulus must be sealed by some means such as 34, so that there will be essentially no flow of liquid down through the annulus and under the bit. If this annulus area were open, then the pressure drop in the liquid between the top surface 18 and the bottom surface 22 of the bit would be too small to create a sizable force on the top of the drill bit. Consequently, this flow of liquid must be gauged by means of the orifices 50 and 52 so that under the desired rate of total flow of liquid there will be sufficient pressure drop between the top and bottom surfaces of the drill bit to provide the desired hold down force.

One type of annular seal (not shown) might be a rotary seal, for example, in which a stationary outer circular part is held to the wall and an inner circular part is attached to the drill bit, and there is sliding sealing contact between the two parts. Because of the great diameter this is a relatively difficult device to design, and one of the simplest and best means of providing the annular seal is indicated in FIG. 3, of which there are several separate views.

Figure 3A:
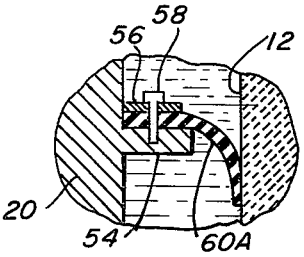
FIGS. 3A, 3B, 3C, 3D, 3E indicate various views of one type of annular seal for use in this invention.
Figure 3B:
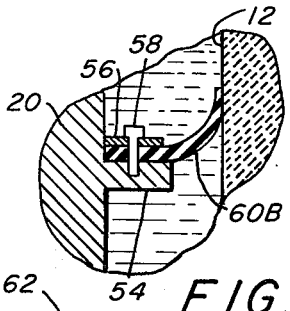
Figure 3C:
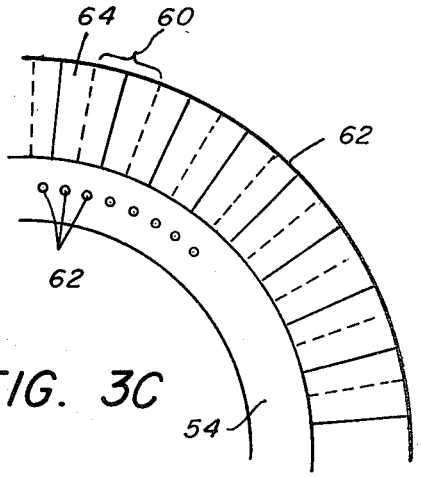
Figure 3E:
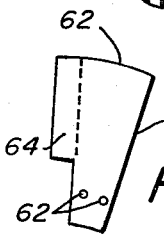
Figure 3D:
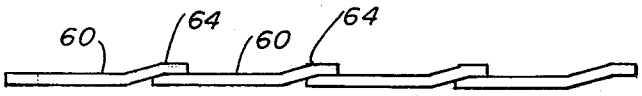

The seal, as shown in FIGS. 3A and 3B includes a circular flange 54 on the outside surface of the wall 20 of the bit. There are a plurality of flaps plates or petals 60, which are attached to the flange by means of screws or rivets 58, through openings 62. A hold down ring 56 may be used, for example. These petals have an overlapping portion 64 as shown in FIGS. 3D and 3E, so that substantially the entire area of the annular space can be closed off. A plan view of the assembly is shown in FIG. 3C, which is self-explanatory.

The radius of the outer edge 62 of the petals is greater than the diameter of the bore hole wall 12, so that the petals will be bent down or bent up as in FIGS. 3A and 3B depending on whether the drill bit is being lifted out of or lowered into the hole. The length and flexibility of the petals is such that in reversing the downward movement of FIG. 3B into an upward movement of FIG. 3A the petals will reverse their bending direction and continue to seal between the bit and the bore hole wall.

In review, the essential features of this invention comprise a bit having a multiplicity of cutters placed at various selected radii on the bottom surface. There is a sealing means to close off the annulus between the bit and the bore hole wall. Drilling liquid is introduced into the annulus and flows through the bit through a selected plurality of orifices of controlled diameter, so that at the desired rate of flow there will be a selected pressure drop across the bit, that is, an increase in the unit pressure on the top surface of the bit as compared to the bottom surface. This differential pressure creates a downward force on the total exposed surface area of the bit, sufficient to provide the cutting force needed. The annular seal can conveniently be made of a plurality of short, thin plates or petals, arranged radially on a flange on the bit, and contacting the wall of the bore hole.

While the invention has been described with a certain degree of particularity it is manifest that many changes may be made in the details of construction and the arrangement of components. It is understood that the invention is not to be limited to the specific embodiments set forth herein by way of exemplifying the invention, but this is to be limited only by the scope of the attached claim or claims, including the full range of equivalency to which each element or step thereof is entitled.

What is claimed is:

1. A drilling system for drilling large diameter holes comprising:

a. drill bit means having a top surface, a substantially cylindrical side wall and a bottom surface, a plurality of cutters on the bottom surface at selected radii, a drill pipe attached to and passing axially through said bit means to the bottom thereof, said drill bit top surface having a substantially larger area than said drill pipe;

b. sliding sealing means to substantially close off the flow of drilling liquid in the annulus between said bit means and the wall of said bore hole;

c. a plurality of orifices of selected size to permit the flow of drilling liquid from above said bit, through said bit to the bottom thereof, and up through said drill pipe;

d. means to introduce drilling liquid in the annulus between the drill pipe and the wall of the bore hole and air lift means in the top of said drill pipe to circulate said drilling liquid;

whereby a selected rate of flow of drilling liquid will be set up through said orifices, creating a pressure drop through said orifices of a selected value, and creating a hold down force on said bit of a selected value.

2. The drilling system as in claim 1 in which the bottom surface of said bit means is a conical surface.

3. The drilling system as in claim 1 in which said bit means is fabricated of plates, and said plurality of orifices comprise two sets of orifices, one set permitting entry of liquid into the inside of said bit near its top, and a second set of orifices in the bottom plate.

4. The drilling system as in claim 3 in which said second set of orifices are positioned at least one at each cutter mounted on the under side of said bottom plate.

5. The drilling system as in claim 1 in which said airlift means comprises a compressed air pipe lowered into the top of said drill pipe to a selected depth.

6. The drilling system as in claim 1 in which said sealing means comprises a radial flange on the outside of the side wall of said bit means and a plurality of radially extending flexible flaps or petals, at least long enough to contact the wall of said bore hole.

7. The drilling system as in claim 6 in which the outer diameter of said petals is greater than the diameter of said bore hole wall.

8. The drilling system as in claim 6 in which said petals overlap adjacent petals.

* * * * *